United States Patent [19]

Doucet et al.

[11] Patent Number: 4,602,376

[45] Date of Patent: Jul. 22, 1986

[54] SOFT X-RAY SOURCE WITH CYLINDRICAL PLASMA COMPRESSION

[75] Inventors: Henri J. Doucet, Les Molières; Michel Gazaix, Antony; Henri Lamain, Clamart; Claude Rouillé, Magny-les-Hameaux; Jean-Pierre Furtlehner, Jouy-en-Josas, all of France

[73] Assignee: Centre National de la Recherche Scientifique, Paris, France

[21] Appl. No.: 643,457

[22] Filed: Aug. 23, 1984

[30] Foreign Application Priority Data

Sep. 2, 1983 [FR] France ..... 83 14085

[51] Int. Cl.[4] ..... H01J 35/00; H05G 1/00; H05H 1/24

[52] U.S. Cl. ..... 378/119; 315/111.71; 376/145

[58] Field of Search ..... 378/119; 376/145, 144, 376/143; 315/111.21, 111.71

[56] References Cited

U.S. PATENT DOCUMENTS 3,746,860 7/1973 Shatas et al. ..... 378/119
3,835,330 9/1974 Baker et al. ..... 378/119

OTHER PUBLICATIONS

Baker et al., Electromagnetic-Implosion Generation of Pulsed High-Energy-Density Plasma; J. Appl. Phys. Sep. 1978, vol. 49, #9.

Baikov et al., Visible and Near-UV Emission in the Electrical Explosion of a Thin Metal Foil; Sov. Phys. Tech. Phys. vol. 20, May '75.

Gutcheck et al., Intense Plasma Source for X-ray Microscopy; 196/SPIE vol. 316 High Resolution Soft X-ray Optics (1981).

Pearlman & Riordan; X-ray Lithography Using a Pulsed Plasma Source; 1190 J. Vac. Sci. Technol., 19(4), Nov./Dec. 1981.

*Primary Examiner*—Bruce C. Anderson
*Assistant Examiner*—T. N. Grigsby
*Attorney, Agent, or Firm*—Birch, Stewart, Kolasch & Birch

[57] ABSTRACT

Intense soft X-ray source comprising a means for producing a cylindrical plasma jet between a cathode and an anode, connected to a pulsed high voltage generator, wherein the means for producing the plasma jet comprises a capacitor bank connected to a charging voltage source and also to a transmission line provided with a tripping means, the assembly having a very low inductance so as to permit a rapid discharge;

a sheet of solid material connected by its periphery to one of the conductors of the line and by its central part to the other conductor, so that a radial discharge can be produced when the tripping means is conductive, a plasma jet resulting from the explosion of the sheet;

a means for giving the said plasma jet a cylindrical shape.

6 Claims, 4 Drawing Figures

SOFT X-RAY SOURCE WITH CYLINDRICAL PLASMA COMPRESSION

BACKGROUND OF THE INVENTION

The present invention relates to an intense soft X-ray source using cylindrical plasma compression, the plasma being obtained from an exploded sheet.

The plasmas to which the invention relates are dense, hot plasmas. Their electron density exceeds approximately $10^{18}$ $cm^{-3}$ and their electron temperature is in the range between a few hundred electron volts to a few kiloelectron volts.

Such plasmas can constitute intense soft X-radiation sources which, compared with other X-ray sources have numerous advantages, such as:

a) their low cost;

b) their overall dimensions are sufficiently reduced to enable them to be positioned at the point of use of the X-radiation;

c) easy to use and maintain;

d) high energy efficiency.

These advantages make such sources suitable for microlithography, whilst also being usable in fast X-ray microscopy.

Some of these sources make use of a cylindrical plasma compression and they are sometimes called "liners".

This known procedure has already been applied to devices produced industrially for microlithographic applications. Thus, the article entitled "X-ray lithography using a pulsed plasma source" published in the Journal of Vacuum Science Technology, 19, 4, November/December 1981, pp.1190–1193 by J. S. Pearlman and J. C. Riordan describes a soft X-ray source essentially comprising a means for producing a cylindrical supersonic plasma jet through a hollow cathode in the direction of an anode. A discharge circuit connects the cathode to the anode through a capacitor bank previously charged by a high voltage source. During the discharge of these capacitors through the plasma jet, there is a cylindrical compression of the latter and a soft X-ray emission results therefrom.

Such a source is also described in the article entitled "Intense plasma source for X-ray microscopy" published in the Journal "SPIE" "Society of Photooptical Instrumentation Engineers", Vol. 316, High Resolution Soft X-ray Optics, 1981, pp. 196 to 202 by R. A. Gutcheck and J. J. Muray. This article also describes a source using a ring of conductor wires whose explosion it causes the cylindrical compression of this ring then taking place.

The temperature and density of the plasmas obtained in such sources are essentially limited by the two following physical phenomena:

a magnetohydrodynamic instability developing in the compressed plasma and which leads to the use of very fast high voltage generators, so as not to allow this instability to develop, the essential parameter defining the performances of the source then being the initial homogeneity of the plasma to be compressed;

the compression is limited by the presence of gas within the cylinder to be compressed, which reduces the final temperature and density obtained.

These two limitations are important in the aforementioned known devices. The plasmas produced by a supersonic gas jet have a relatively good homogeneity, but interactions between the supersonic jet and the walls, electrodes, etc leads to shock waves in the jet, which introduce gas into the cylinder to be compressed. The plasmas produced by explosion of the wires have a mediocre homogeneity and also are unsuitable for machines with a modest power level.

SUMMARY OF THE INVENTION

The object of the invention is to obviate these disadvantages by a special plasma jet production means.

According to the invention, the plasma jet is produced by the explosion of a sheet of easily condensible, solid material. The explosion of the sheet is produced by the rapid discharge of a capacitor bank across a very low inductance transmission line. The plasma produced by the explosion is accelerated by the electrodynamic forces resulting from the radial current and the associated azimuthal magnetic field. This plasma passes through an area giving it a cylindrical shape and is then introduced into the interelectrode gap of a conventional pulsed electrical machine.

The plasma obtained by the device according to the invention is much better adapted to the production of soft X-rays than the supersonic plasma jets obtained by the prior art means for the following reasons. In a prior art device, the means for obtaining the jet is a fast valve, i.e. a mechanical means. Its opening is not instantaneous and the plasma jet produced has characteristics which evolve. In particular, the density of the plasma increases as a function of time in a way which is substantially linear. Before controlling the discharge which will cause the implosion of the plasma jet, it is necessary to wait for it to reach its optimum density. In practice, with such machines, it is conventional practice to delay the main discharge by roughly 1 millisecond. It is obvious that all the ion produced during this time are lost and that considerable disturbances (shock waves, gases in the cylinder, etc) will have plenty of time to develop.

These disadvantages are obviated by the means according to the invention. Thus, the plasma jet results from electrodynamic forces and no longer from mechanical forces having a much greater efficiency, so that in less than 1 microsecond, the plasma jet acquires the requisite properties to enable the compression to take place.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
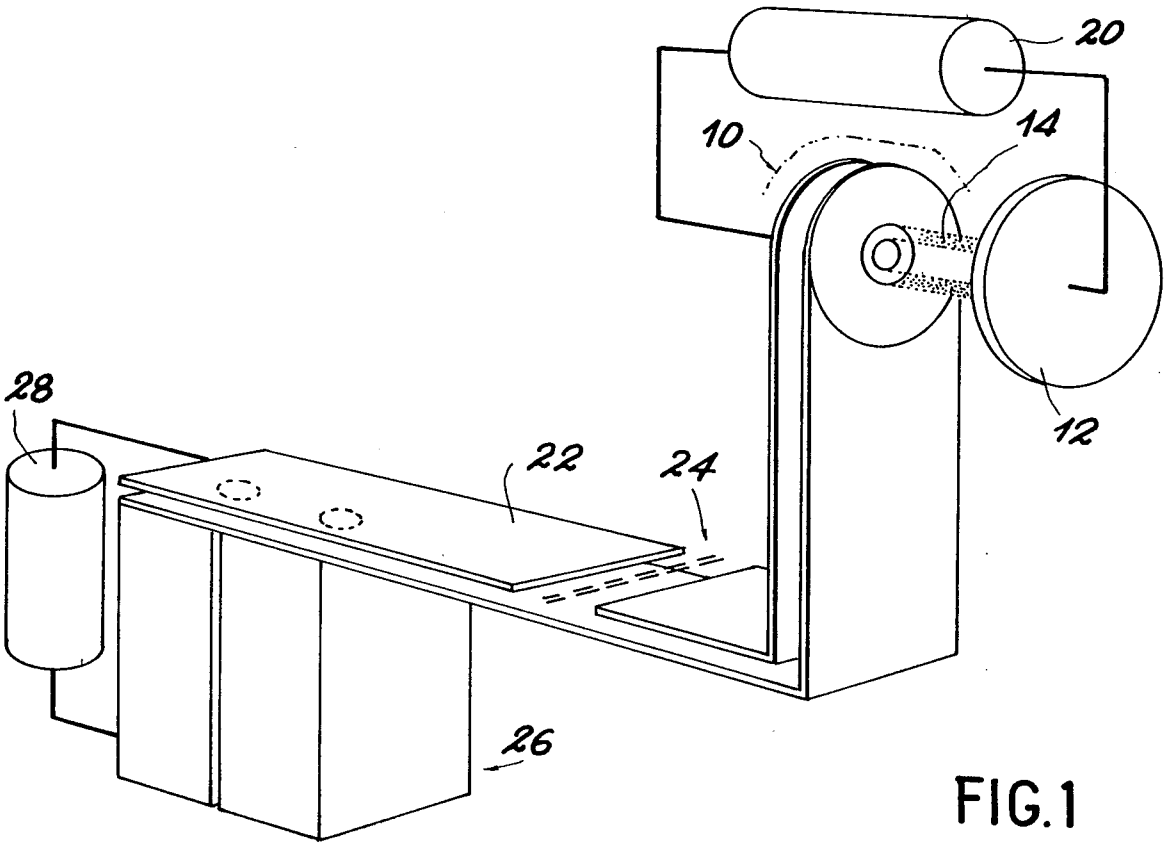
FIG. 1 a general diagram of a source according to the invention.

The device shown in FIG. 1 is a soft X-ray source comprising an anode 10 and a cathode 12, between which is formed a cylindrical plasma jet 14. This plasma is compressed by the effect of a discharge caused by a pulsed high voltage generator 20. The plasma jet production means is illustrated in greater detail in FIG. 2. This means is connected to a flat line 22 having two conductors, said line being provided with a spark gap 24. The line is connected to a capacitor bank 26 charged by a high voltage source 28.

Figure 2:
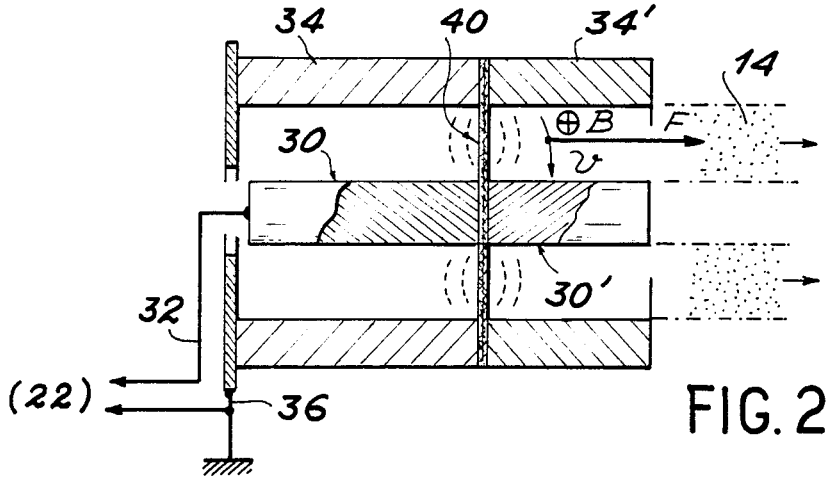
FIG. 2 a diagrammatic section of means for forming a plasma by the explosion of a sheet.

FIG. 2 diagrammatically shows the plasma jet formation means. As shown, this means comprises a central cylindrical electrode 30 connected to a plate 32 belonging to the flat line 22 and carrying the high voltage and an electrode 34 in the form of a hollow tube connected to another plate 36, which is e.g. earthed, so that there are two coaxial electrodes. A sheet 40 is engaged against electrodes 30 and 34 by parts 30' and 34' at the end of the electrodes. Thus, the current making the sheet explode circulates from the periphery towards the center. A plasma is produced on either side of said sheet during the explosion thereof. This plasma is subject to the Laplace force $F=B \quad v$ resulting from the section of the azimuthal magnetic induction B produced by the current and the displacement of the ions at velocity v. Thus, a plasma 14 is projected in the direction of cathode 12 (not shown in FIG. 2).

Thus, the plasma produced is dense and cold. It is accelerated, as in a Marshall gun, and penetrates the interelectrode gap, whilst undergoing a stripping by ring 34', which limits the external diameter of the plasma cylinder to be compressed. If the generator 20 for compressing the plasma is not connected, the plasma strikes the cathode of the machine and condenses in the form of a ring. The dimensions of this ring are very close to those of the circular opening which has defined the jet (ring between parts 30' and 34'). The quantity of material deposited in the ring exceeds 20% of the total weight of the sheet, which demonstrates the quality of the plasma cylinder produced. The latter is in rapid recombination during its expansion, but will be reionized in a time less than 1 nanosecond when the high voltage pulse from the pulsed generator arrives.

Figure 3:
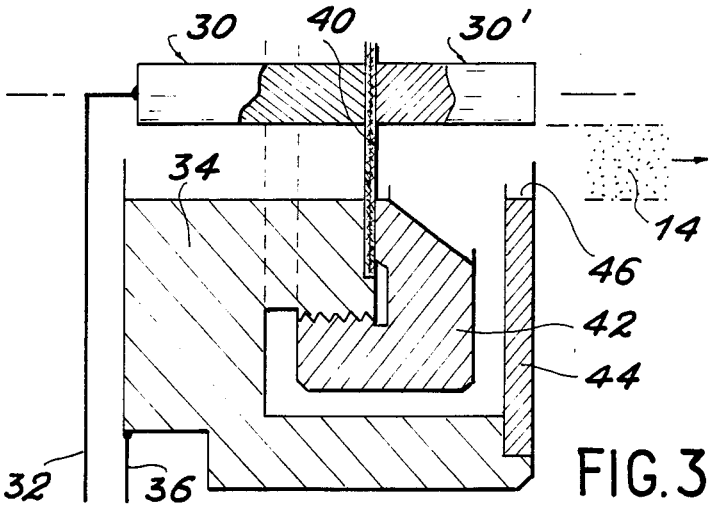
FIG. 3 an embodiment of means making it possible to give the plasma jet a cylindrical shape.

In FIG. 2, ring 34' and part 30' give the plasma jet its cylindrical shape. However, naturally other means can be used for this purpose, FIG. 3 giving another example thereof. It is possible to see on the one hand, a cylindrical wedge 42 for fixing the periphery of the sheet to electrode 34 and, on the other hand, a disk 44 having a circular opening 46 defining, with cylinder 30', a circular slot giving the plasma jet its cylindrical shape.

Figure 4:
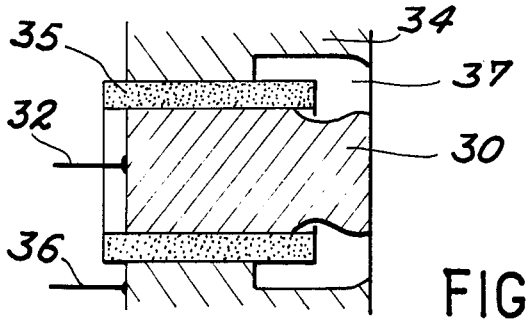
FIG. 4 a possible shape for the electrodes connected to the sheet.

FIG. 4 shows in greater detail an embodiment of two electrodes 30 and 34, which are separated by an insulating cylinder 35. They are also machined so as to give a material-free ring 37, onto the front of which is engaged the sheet to be exploded.

In a special embodiment, the capacitor bank 35 is constituted by two parallel-connected 4nF capacitors. The energy is transmitted with the aid of a flat line using a sliding discharge on the surface of a dielectrtic. The assembly is charged to 20 kV and discharged in about 800 ns into an approximately 10 micron thick aluminium sheet. The assembly formed by the capacitor-bank, the line, the spark gap and the sheet support has a limited inductance of about 20 nH to permit a rapid discharge.

Experience and measurements performed by the inventors show that after the impacts on the cathode, the aluminium plasma cylinder is indeed empty. By measuring the dimensions of these impacts, it has been found that the internal diameter is close to 20 mm and the external diameter hardly exceeds 22 mm, which is the diameter of the disk which strips the plasma when it enters the interelectrode gap.

Very various materials can be used for forming the sheet. Firstly, they can consist of simple materials permitting the passage of the current, i.e. metals, preference being given to those whose resistivity is not too low, so that the heating by the Joule effect does not require prohibitive energy levels. Preference is given to copper or silver, as well as aluminium, tungsten, iron, stainless steel, gold, etc. The lower the resistivity of the metal, the thinner must be the sheet. However, as for the exploded wire technology, refractory materials can also be used.

An essential criterion guiding the choice of material is its condensible nature, i.e. its capacity to be deposited in solid form on the walls of the enclosure, where the plasma develops. There must indeed be a good condensation, so that there are few or no shock waves liable to disturb the plasma. In this connection, the inventors have shown that very condensible materials such as cesium are particularly suitable.

It is possible to use sheets which are composite in their composition, in that they comprise more than one material. For example, it is possible to use a thin graphite sheet containing cesium in the interstitial position. It is known that in such a body there are approximately 15 cesium atoms for each graphite atom, so that the equivalent of a true cesium sheet is obtained.

The sheet can also be composite in its structure, in the sense that it can comprise two sheets of different materials. For example, a tungsten sheet can be covered by a sheet of a plastic material, such as polyethylene. The tungsten will permit the radial discharge and will cause the explosion of the sheet, including the plastic. The resulting plasma will contain both heavy ions (particularly tungsten) and light ions (particularly hydrogen and carbon). As the tungsten ions are much heavier than the hydrogen and carbon ions, there will very rapidly be a hydrogen and carbon plasma at some distance from the exploded sheet.

With such composite sheets, it is therefore possible to form plasma jets, whose composition develops over a period of time. This change of nature of the plasma can lead to soft X-rays covering a certain spectrum.

The sheet can also be formed from two spaced sheets, defining between them a volume which can be filled with gas. For example, two aluminium sheets, each of which is 2 $\mu$m thick, can have a spacing of 1 mm, the volume between these two sheets being filled with gas, e.g. argon, so that an argon plasma is obtained.

It is clear that there is a very wide choice for the material for forming the sheet. The coaxial electrodes and parts limiting the shape of the jet can be made from graphite.

In both the source according to the invention and that of the prior art, the X-rays are emitted both radially and axially. Preference is given to the latter, which means that the cathode must have a central opening.

What is claimed is:

1. An intense soft X-ray source comprising a means for producing a cylindrical plasma jet between a cathode and an anode, connected to a pulsed high voltage generator, wherein the means for producing the plasma jet comprises:

a capacitor bank connected to a charging voltage source and also to a two conductor transmission line provided with a tripping means, the assembly having a very low inductance so as to permit a rapid discharge, said two conductors being coaxially arranged a sheet of solid material connected by its periphery to one of the conductors of the line and by its central part to the other conductor, so that a radial discharge can be produced when the tripping means is conductive, a plasma jet resulting from the explosion of the sheet, and means for giving the said plasma jet a cylindrical shape.

2. A source according to claim 1, wherein the sheet is made from metal.

3. A source according to claim 1, wherein the sheet is composite and comprises at least two different materials.

4. A source according to claim 1, wherein the sheet is constituted by two spaced sheets defining a gas-filled volume.

5. A source according to claim 1, wherein the sheet comprises at least two sheets of different materials engaged against one another.

6. A source according to claim 1, wherein the means for giving the plasma jet a cylindrical shape comprises a ring, whose internal diameter defines the external diameter of the jet.

* * * * *